US007523841B2

(12) United States Patent
König

(10) Patent No.: US 7,523,841 B2
(45) Date of Patent: Apr. 28, 2009

(54) TRAY FOR STORING AND INDIVIDUALLY DISPENSING TABLETS

(75) Inventor: Helmuth König, St. Valentin (AT)

(73) Assignee: PEZ International AG, Traun (AT)

( * ) Notice: Subject to any disclaimer, the term of this patent is extended or adjusted under 35 U.S.C. 154(b) by 1079 days.

(21) Appl. No.: 10/311,493

(22) PCT Filed: Jun. 19, 2001

(86) PCT No.: PCT/AT01/00196

§ 371 (c)(1),
(2), (4) Date: Dec. 16, 2002

(87) PCT Pub. No.: WO01/98177

PCT Pub. Date: Dec. 27, 2001

(65) Prior Publication Data

US 2003/0132239 A1 Jul. 17, 2003

(30) Foreign Application Priority Data

Jun. 20, 2000 (AT) ..... A 1060/2000

(51) Int. Cl.
*B65H 1/08* (2006.01)

(52) U.S. Cl. ..... 221/232; 221/279; 221/24; 221/197; 221/270

(58) Field of Classification Search ..... 221/279, 221/24, 197, 270, 199, 229, 269; 267/170, 267/174; 406/304, 229, 166
See application file for complete search history.

(56) References Cited

U.S. PATENT DOCUMENTS 2,802,575 A * 8/1957 Jeune et al. ..... 108/106
2,833,442 A * 5/1958 Larsen ..... 312/71
3,409,172 A * 11/1968 Fuglsang-Madsen et al. ..... 221/229
3,612,349 A * 10/1971 Thomas ..... 221/4
3,845,882 A * 11/1974 Hass ..... 221/279
3,861,563 A * 1/1975 Lisbin et al. ..... 221/279

(Continued)

FOREIGN PATENT DOCUMENTS

AT 387760 B 3/1989

(Continued)

*Primary Examiner*—Patrick Mackey
*Assistant Examiner*—Michael E. Butler
(74) *Attorney, Agent, or Firm*—Collard & Roe, P.C.

(57) ABSTRACT

A magazine (3) for a tablet dispenser (1) for receiving and sequentially dispensing tablets (T) consists of a housing (4) which is substantially cuboid and is open on the longitudinal side (5), receives a longitudinally guided slider (6) and a helical spring (8) supported between the slider (6) and the housing floor (7) and comprises an output device (10) at the housing head (9) which is opposite of the housing floor (7), with the helical spring (8) engaging with its floor-side end (11) of the winding in a clamping gap (12) in the region of the floor of the housing. In order to ensure a secure hold of the helical spring (8) within the housing, the width (w) of the clamping gap (12) formed between the housing floor (7) and a projecting wall (13) disposed upstream of the same is dimensioned larger than twice the diameter (d) of the spring wire and smaller than the winding distance (a) or an integral multiple of the winding distance (a) of the unloaded helical spring (8), and the helical spring (8) is inserted into the clamping gap (12) with a winding end (11) aligned towards the open longitudinal side (5) of the housing.

6 Claims, 2 Drawing Sheets

U.S. PATENT DOCUMENTS

Figure 1:
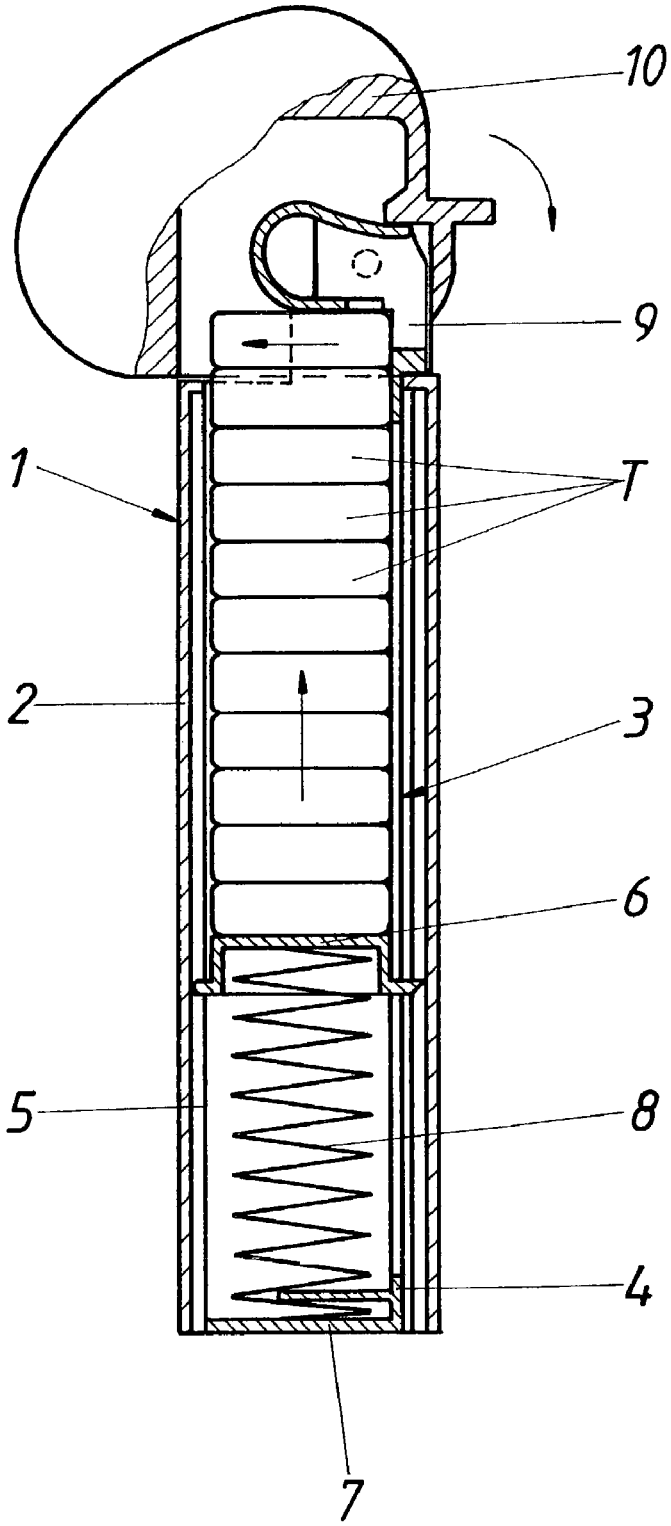

| | | | | | |
|---|---|---|---|---|---|
| 4,243,153 | A | * | 1/1981 | Mitchell | 221/34 |
| 4,589,575 | A | * | 5/1986 | Rigberg et al. | 221/198 |
| 4,966,305 | A | * | 10/1990 | Hinterreiter | 221/229 |
| 5,048,720 | A | * | 9/1991 | Hoke | 221/198 |
| 5,071,033 | A | * | 12/1991 | Siwek | 221/229 |
| 5,080,258 | A | * | 1/1992 | Hinterreiter | 221/198 |
| 5,178,298 | A | * | 1/1993 | Allina | 221/24 |
| 5,377,865 | A | * | 1/1995 | Thomson | 221/93 |
| 5,673,814 | A | * | 10/1997 | Terashima et al. | 221/227 |
| 6,425,495 | B1 | * | 7/2002 | Senda et al. | 221/24 |
| 6,543,639 | B1 | * | 4/2003 | Kovens | 221/24 |

FOREIGN PATENT DOCUMENTS

| | | |
|---|---|---|
| GB | 1512277 | 5/1978 |
| GB | 2307231 | 5/1997 |

* cited by examiner

TRAY FOR STORING AND INDIVIDUALLY DISPENSING TABLETS

CROSS REFERENCE TO RELATED APPLICATIONS

Applicants claim priority under 35 U.S.C. §119 of AUSTRIA Application No. A1060/2000 filed on 20 Jun. 2000. Applicants also claim priority under 35 U.S.C. §365 of PCT/AT 01/00196 filed on 19 Jun. 2001. The international application under PCT article 21(2) was not published in English.

The invention relates to a magazine for a tablet dispenser for receiving and sequentially dispensing tablets with a housing which is substantially cuboid and is open on the longitudinal side, receives a longitudinally guided slider and a helical spring supported between the slider and the housing floor and comprises an output device at the housing head which is opposite of the housing floor, with the helical spring engaging with its floor-side end of the winding in a clamping gap in the region of the floor.

Such magazines are inserted into a protective sleeve from the floor side to the housing head and are used as storage containers and ejectors mostly for refreshment tablets and lozenges which come with a basic shape that allows them to be stacked. Such tables are inserted in stacks through the open longitudinal side into the magazine housing between the housing head and the slider, so that the stack of tablets, as a result of the pressure load, are pressed via the slider against the housing head and towards the output device. An actuation of the output device will then push the uppermost tablet of the stack out of the housing transversally to the direction of stacking in the housing and release the same for removal. The helical spring loading the slider rests loosely at one end on the slider and at the other end on the housing floor, as a result of which the spring can spring out of the housing in the case of improper use of the magazine and especially in the case of damage or breakage of the protective sleeve and/or the magazine housing, which can lead to the likelihood of injury. In order to prevent this it has already been proposed (AT 387 760 B) that the floor-side end of the winding of the helical spring is fixed in a clamping gap in the housing, with the clamping gap being produced between the housing floor and a pin stop and being adjusted with respect to its width to the diameter of the spring wire. The end of the winding therefore rests in a flat fashion on the housing floor and slips out of the clamping gap under a respective action of force parallel to the floor. The spring loses its hold and an ejection of the spring, including the thus following likelihood of injury, is still possible in the case of damage.

The invention is therefore based on the object of providing a magazine of the kind mentioned above which is characterized by a simple and still efficient securing of the spring.

This object is achieved by the invention in such a way that the width of the clamping gap formed between the housing floor and a projecting wall disposed upstream of the same is larger than twice the diameter of the spring wire and smaller than the winding distance of the still unloaded helical spring and the helical spring is inserted into the clamping gap with a winding end aligned towards the open longitudinal side of the housing. As a result of the thus formed and dimensioned clamping gap, the helical spring is pretensioned in the zone of the winding end during the insertion into the clamping gap and the winding end rests under an acute angle under pretensioning load on the housing floor. In the case of any damage to the magazine or in the case of any efforts to pull out the spring from the magazine housing, the supporting force of the winding end increases due to the occurring spreading effect and the winding end prevents the withdrawal of the spring in the manner of a barb. The helical spring is held securely in the housing and the likelihood of injury as a result of a detaching spring is prevented.

The spreading or barbing effect of the spring securing means improves when the winding end projects upwardly in the clamping gap up to approximately the height of the longitudinal axis of the spring, so that a supporting angle of the winding end relative to the housing floor is obtained which promotes the barb-like support.

If the winding end forms a sharp-edged cutting surface, the winding end will dig into the housing floor in the case of a respective tensile load and a positive lock occurs which prevents the extraction of the spring.

Figure 2:
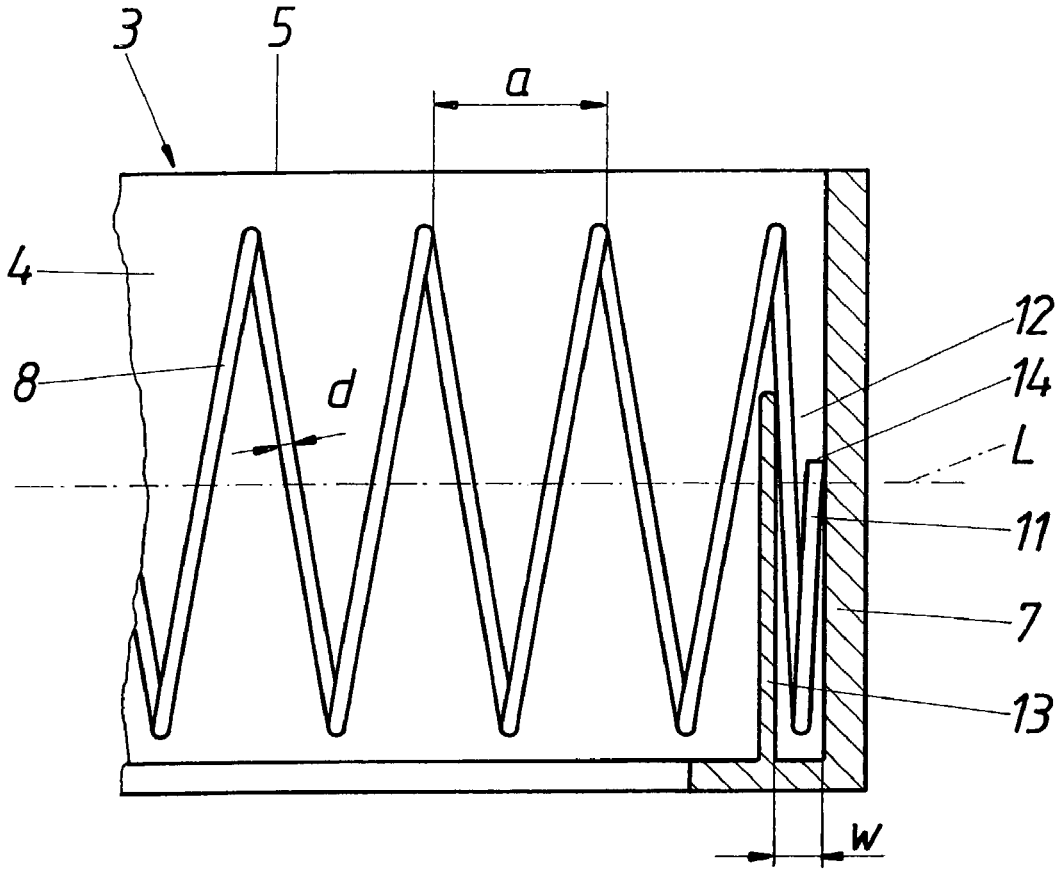
Figure 3:
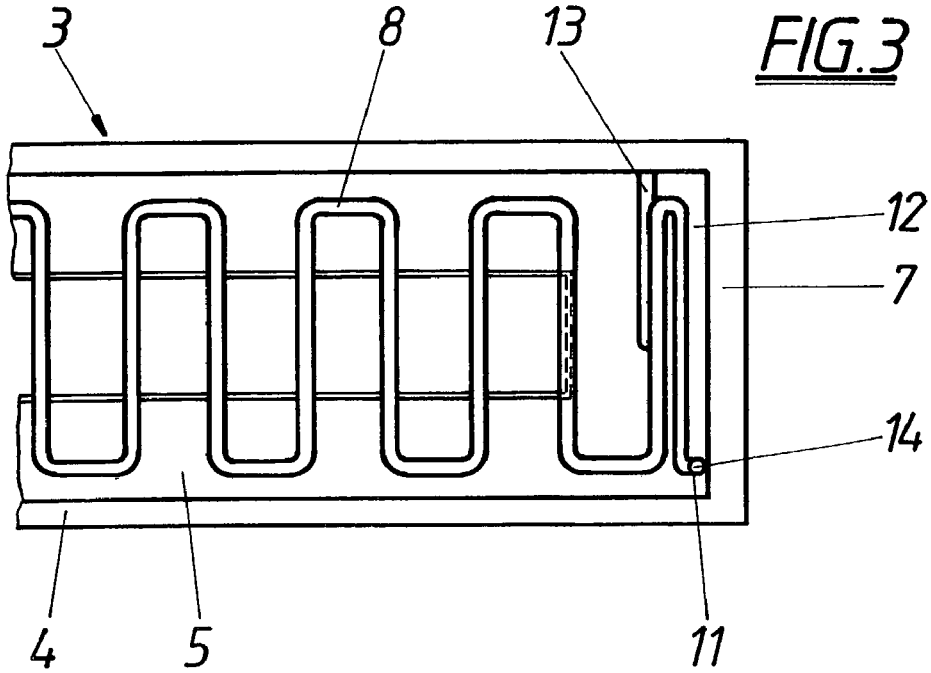

The subject matter of the invention is now shown in the drawings by way of example, wherein:

FIG. 1 shows a magazine in accordance with the invention in a longitudinal sectional view, and FIGS. 2 and 3 show the floor zone of the magazine housing in a longitudinal sectional view and in a top view on an enlarged scale.

A tablet dispenser 1 consists of an outer protective sleeve 2 and a magazine 3 as inserted into the protective sleeve for receiving and sequentially dispensing tablets T. For this purpose the magazine 3 forms a substantially cuboid housing 4 which is open at a longitudinal side 5 for inserting a stack of tablets and receives, for the purpose of holding the tablets T inserted in form of a stack, a longitudinally guided slider 6 and a helical spring 8 which is supported between the slider 6 and a housing floor 7 and has an approximately oval winding shape which is adjusted to the cross section of the housing. For the purpose of sequentially dispensing tablets the housing 4 is provided with an output device 10 at the housing head 9 which is opposite of the housing floor 7, so that as a result of a pivoting actuation of the output device 10 the tablets T which are pressure loaded through the helical spring 8 towards the housing head 9 can be pushed out sequentially transversally to the direction of stacking from the tablet dispenser 1 for the purpose of removal.

In order to securely prevent any jumping away of the helical spring as inserted in the housing 4 when the tablet dispenser 1 is damaged, the helical spring 8 engages with its floor-side winding end 11 in a clamping gap 12 which is obtained by the housing floor 7 and an upstream projecting wall 13. The width w of the clamping gap 12 is larger than twice the diameter d of the spring wire, but smaller than the winding distance a of the unloaded helical spring 8, and the helical spring is inserted into the clamping gap 12 with the winding end 11 aligned towards the open longitudinal side 5 of the housing. In this way the helical spring is pretensioned within the clamping gap 12 and the pretensioning force presses the winding end 11 in an acute angle against the housing floor 7, so that a spreading and barbing effect is produced which prevents any extraction of the spring end from the clamping gap 12. Said barbing and spreading effect is improved further in such a way that the winding end 11 projects upwardly only up to approximately the height of the longitudinal axis L of the spring and forms a sharp-edge cutting surface 14.

The invention claimed is:

1. A magazine for a tablet dispenser for receiving and sequentially dispensing tablets, which comprises (a) a substantially cuboid housing (1) a floor, (2) a head opposite the floor and comprising an output device, and (3) a longitudinal side extending between the floor and the head, the longitudinal side having an opening, (b) a longitudinally guided slider received in the housing, and (c) a helical spring comprised of a coiled wire and supported between the floor of the housing and the longitudinally guided slider, an end of the helical spring supported on the floor being inserted in a clamping gap extending between the floor of the housing and a projecting wall disposed upstream of the floor, the winding of the helical spring at the end being aligned towards the longitudinal wall, and the clamping gap having a width between the floor and the projecting wall which is larger than twice the diameter of the coiled wire and smaller than the distance between the windings of the unloaded helical spring.

2. The magazine of claim 1, wherein the winding of the helical spring at the end supported on the floor extends to the longitudinal axis of the helical spring.

3. The magazine of claim 1, wherein the winding of the helical spring at the end supported on the floor has a sharp-edged cutting surface.

4. A magazine for a tablet dispenser for receiving and sequentially dispensing tablets, which comprises (a) a substantially cuboid housing (1) a floor, (2) a head opposite the floor and comprising an output device, and (3) a longitudinal side extending between the floor and the head, the longitudinal side having an opening, (b) a longitudinally guided slider received in the housing, and (c) a helical spring comprised of a coiled wire and supported between the floor of the housing and the longitudinally guided slider, an end of the helical spring supported on the floor being clamped in a clamping gap extending between the floor of the housing and a projecting wall disposed upstream of the floor, the winding of the helical spring at the end being aligned towards the longitudinal wall, and the clamping gap having a width between the floor and the projecting wall which is larger than twice the diameter of the coiled wire and smaller than an integral multiple of the distance between the windings of the unloaded helical spring.

5. The magazine of claim 4, wherein the winding of the helical spring at the end supported on the floor extends to the longitudinal axis of the helical spring.

6. The magazine of claim 4, wherein the winding of the helical spring at the end supported on the floor has a sharp-edged cutting surface.

* * * * *